US006082885A

United States Patent [19]

Belfer

[11] Patent Number: 6,082,885

[45] **Date of Patent: *Jul. 4, 2000**

[54] HONEYCOMB CELLULAR REFLECTOR WITH LIGHT SOURCES

[76] Inventor: Bruce D. Belfer, 6 Barbara La., Ocean, N.J. 07712

[ * ] Notice: This patent is subject to a terminal disclaimer.

[21] Appl. No.: 09/058,996

[22] Filed: Apr. 13, 1998

Related U.S. Application Data

[63] Continuation-in-part of application No. 08/926,016, Sep. 9, 1997, Pat. No. 5,873,645.

[51] Int. Cl.[7] ..... F21V 7/00

[52] U.S. Cl. ..... 362/554; 362/297

[58] Field of Search ..... 362/812, 800, 362/290, 241, 242, 346, 240, 247, 232, 239, 238, 237, 250, 297, 225; 40/541; 313/500, 511

[56] References Cited

U.S. PATENT DOCUMENTS

| | | | |
|---|---|---|---|
| 4,241,277 | 12/1980 | Hintze | 313/511 |
| 4,271,408 | 6/1981 | Teshima | 362/800 |
| 4,754,202 | 6/1988 | Havel | 313/500 |
| 5,819,454 | 10/1998 | Rosenitsch | 362/240 |
| 5,873,645 | 2/1999 | Belfer | 362/297 |
| 5,924,785 | 7/1999 | Zhang | 362/240 |

*Primary Examiner*—Sandra O'Shea
*Assistant Examiner*—Hargobind S. Sawhney
*Attorney, Agent, or Firm*—Ezra Sutton

[57] ABSTRACT

A cellular reflector for producing a pattern of light includes a honeycomb cell structure having a plurality of connected cells. The present invention adds a plurality of light sources for producing light within a selected plurality of the connected cells and an electrical PC mounting board having sockets therein for connecting the plurality of light sources to a power supply. Each of the connected cells have reflective walls for reflecting light from the plurality of light sources to produce the pattern of light. The cellular reflector further includes a control depth adjuster plate for adjusting the depth of the plurality of light sources in the plurality of connected cells for controlling the pattern of light reflected from the reflective walls of the plurality of connected cells.

60 Claims, 12 Drawing Sheets

HONEYCOMB CELLULAR REFLECTOR WITH LIGHT SOURCES

This is a continuation-in-part of application Ser. No. 08/926,016, filed on Sep. 9, 1997, now U.S. Pat. No. 5,873,645.

FIELD OF INVENTION

The present invention relates to a honeycomb cellular reflector having a plurality of light sources for producing light therein. More particularly, the honeycomb cellular reflector may include light sources such as LEDs, laser diodes, incandescent bulbs, fluorescent bulbs or neon lamps mounted within or behind a plurality of reflector cells for making such devices as automobile head lamps, signs, traffic signal lights, overhead lamps, television screens, or VDT displays.

BACKGROUND OF INVENTION

Light sources such as fluorescent bulbs, incandescent light bulbs, neon lamps, light emitting diodes (LEDs) are well known for providing light in various applications for the home, the work place, for industrial equipment, for vehicles, for highways and roads to name a few.

There remains a need to provide an efficient lighting structure for use with various light sources for controlling and focusing divergent light in an efficient manner to narrow or widen the beam of light.

DESCRIPTION OF THE PRIOR ART

Honeycomb cell structures for use in electrical devices using various materials of construction have been disclosed in the prior art. For example, U.S. Pat. No. 2,985,784 to MacNeille discloses optical image-forming devices. A cathode-ray type of an electronic tube includes an image-forming face plate in the form of a cellular structure. The individual cells of the cellular structure are filled with phosphorescent material to produce image-forming light in conventional cathode ray tubes. This prior art patent does not disclose the particular structure and design of the honeycomb cellular reflector of the present invention.

U.S. Pat. No. 3,543,384 discloses parallel-hole collimators for use with scintillation cameras and low-energy isotopes. The parallel tube collimator includes a plurality of hexagonal collimating tubes that are stacked and adhered together to form a continuous honeycomb structure with a plurality of hexagonal passages through which radiation may pass. This prior art patent does not disclose the particular structure and design of the honeycomb cellular reflector of the present invention.

None of these prior art patents disclose the particular structure and design of a honeycomb cellular reflector which uses various types of light sources for controlling and focusing divergent light in an efficient manner to narrow or widen the pattern of light produced by the cellular reflector as shown in the present invention.

Accordingly, it is an object of the present invention to provide a honeycomb cellular reflector in combination with various light sources in order to optimize the light output and to provide new applications using the honeycomb cellular reflector.

Another object of the present invention is to provide a honeycomb cellular reflector for use with various internal light sources for controlling and focusing divergent light in an efficient manner in order to narrow or widen the beam or pattern of light coming from the plurality of connected cells of the honeycomb cell structure.

Another object of the present invention is to provide a honeycomb cellular, reflector that has a variety of individual cellular structures including triangles, squares, rectangles, octagons and other polygon configurations.

Another object of the present invention is to provide a honeycomb cellular reflector with light sources to produce new applications for use as signs, car head lamps, overhead street lamps, traffic signal lights, television screens, photocopying devices, photolithography devices, VDT displays and the like.

A further object of the present invention is to provide a honeycomb cellular reflector with light sources that can be mass produced in an automated and economical manner and is readily affordable.

SUMMARY OF THE INVENTION

In accordance with the present invention there is provided a cellular reflector for producing a pattern of light. The cellular reflector includes a honeycomb cell structure having a plurality of connected cells, wherein each of the connected cells has depth; a plurality of light sources for producing light within a selected plurality of the connected cells; an electrical PC mounting board having sockets or receptacles therein for connecting the plurality of light sources to a power supply; and each of the connected cells having reflective walls for reflecting light from the plurality of light sources to produce the pattern of light. The cellular reflector further includes a control depth adjuster plate for adjusting the depth and/or angle of the plurality of light sources in the plurality of connected cells for controlling the pattern of light reflected form the reflective walls of the plurality of connected cells.

BRIEF DESCRIPTION OF THE DRAWINGS

Further objects, features, and advantages of the present invention will become apparent upon consideration of the detailed description of the presently-preferred embodiments, when taken in conjunction with the accompanying drawings wherein.

DETAILED DESCRIPTION OF THE PREFERRED AND ALTERNATE EMBODIMENTS

OVERVIEW

Figure 14:
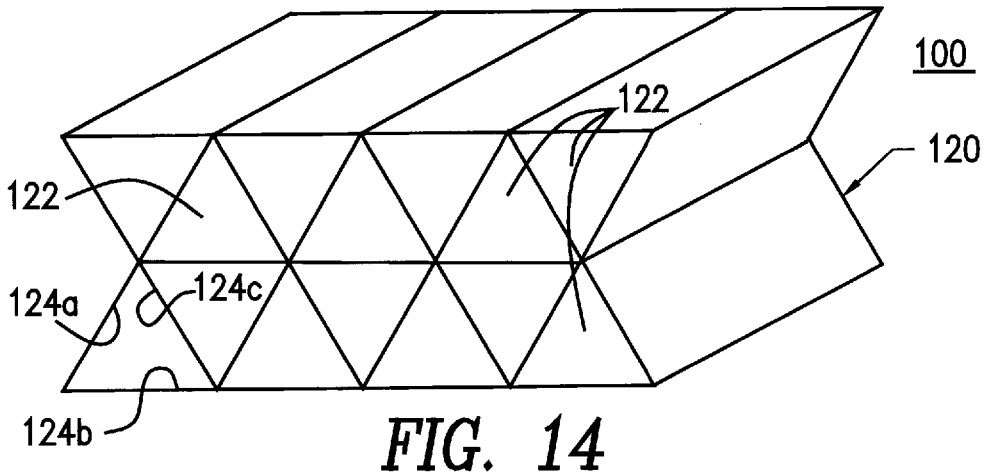
FIG. 14 is a perspective view of the honeycomb cellular reflector of the first alternate embodiment of the present invention showing the honeycomb cell structure having a plurality of connected cells with a triangular shape.
Figure 15:
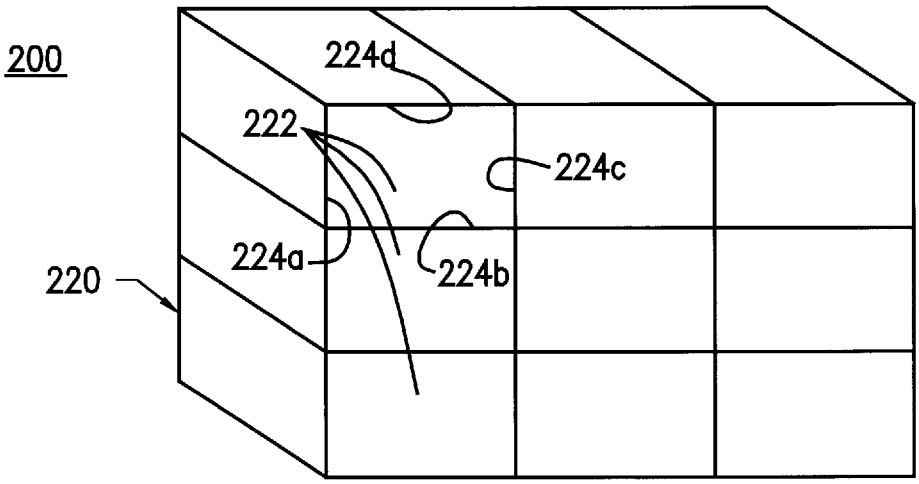
FIG. 15 is a perspective view of the honeycomb cellular reflector of the second alternate embodiment of the present invention showing the honeycomb cell structure having a plurality of connected cells with a rectangular shape.
Figure 16:
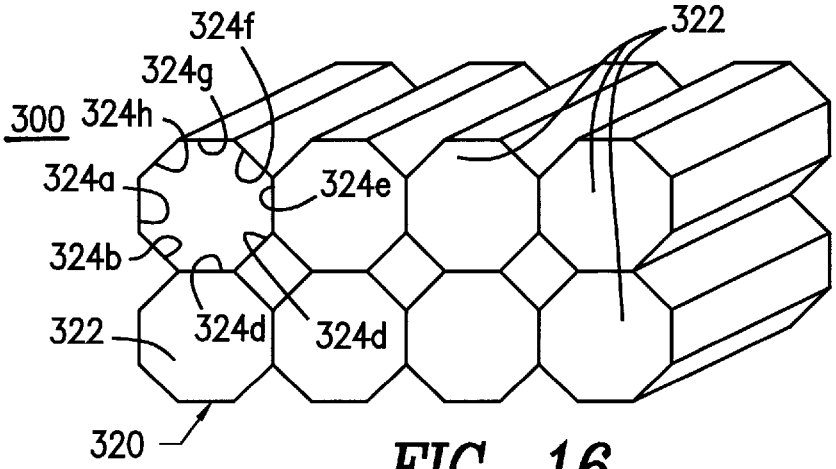
FIG. 16 is a perspective view of the honeycomb cellular reflector of the third alternate embodiment of the present invention showing the honeycomb cell structure having a plurality of connected cells with an octagonal shape.

The honeycomb cellular reflector 10, 10', 10", 100, 200 and 300 of the preferred and alternate embodiments of the present invention are represented in detail by FIGS. 1 through 18 of the drawings. The honeycomb cellular reflector 10 of the preferred embodiment includes a honeycomb cell structure 20 having a plurality of connected cells 22, as shown in FIGS. 1 to 13, wherein each of the connected cells 22 has a hexagonal shape. The honeycomb cellular reflectors 100, 200 and 300 of the alternate embodiments include honeycomb cell structures 120, 220 and 320, respectively, as shown in FIGS. 14, 15 and 16 of the drawings. Honeycomb cell structure 120, as shown in FIG. 14, includes a plurality of connected cells 122, wherein each of the connected cells 122 has a triangular shape. Honeycomb cell structure 220, as shown in FIG. 15, includes a plurality of connected cells 222, wherein each of the connected cells 222 has a rectangular shape. Honeycomb cell structure 320, as shown in FIG. 16, includes a plurality of connected cells 322, wherein each of the connected cells 322 has an octagonal shape. In all other respects the honeycomb cellular reflectors 100, 200 and 300 of the first, second and third alternate embodiments operate and function in the same manner as the honeycomb cellular reflector 10 of the preferred embodiment.

The honeycomb cellular reflector 10, as shown in FIGS. 8 through 11, include various light sources 30 such as light emitting diodes (LEDs) 32, laser diodes 34, incandescent light bulbs 36, fluorescent light bulbs 38, neon lamps 40, high intensity light bulbs 42, halogen bulbs 44, or the emitting end of a fiber optic strand or bundle being mounted to produce light within a plurality of reflector cells 22 for making such devices as road-sign lighting fixtures 80, lighting fixtures 84 for general illumination, televisions, photocopying machines 94, cathode ray tubes, or electron guns.

DETAILED DESCRIPTION OF THE PREFERRED EMBODIMENT 10

Figure 1:
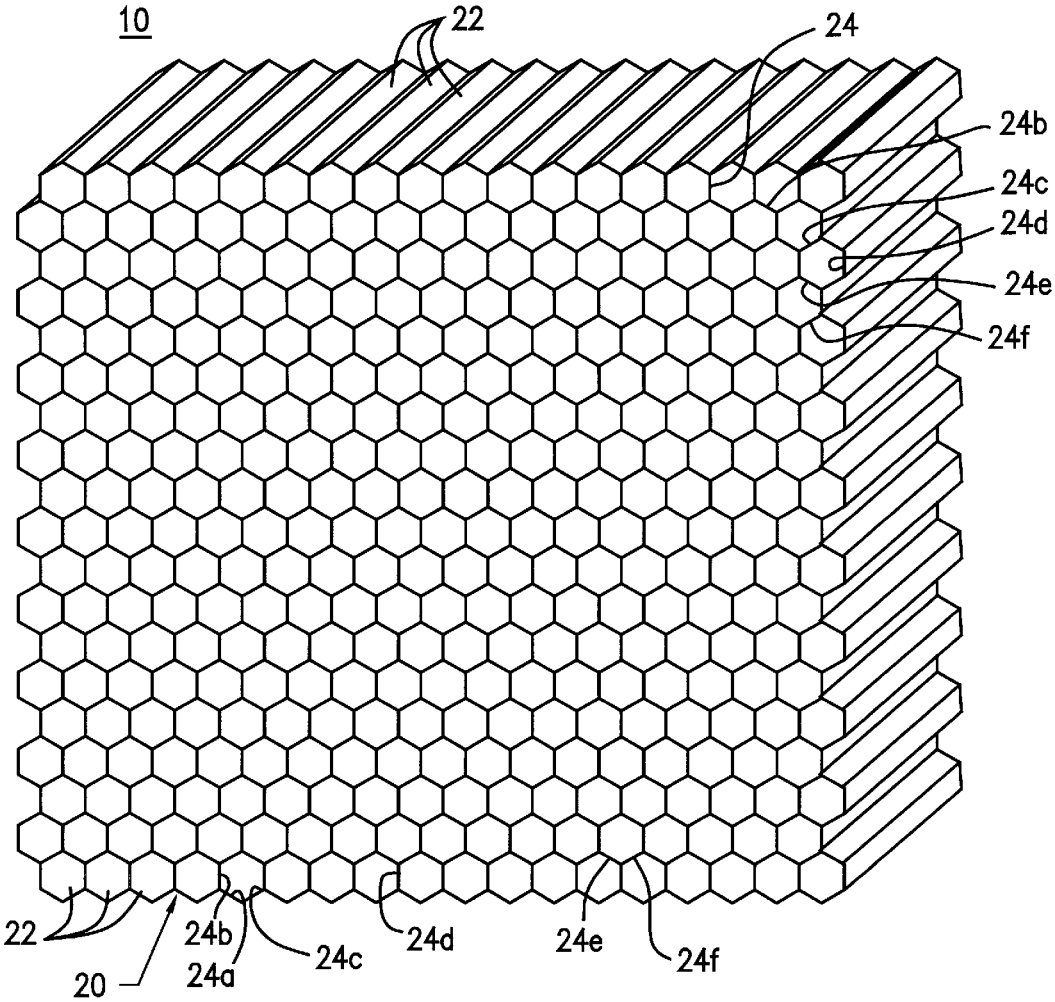
FIG. 1 is a perspective view of the honeycomb cellular reflector of the preferred embodiment of the present invention showing the honeycomb cell structure having a plurality of connected cells with reflective walls therein.

The honeycomb cellular reflector 10 and its component parts of the preferred embodiment of the present invention are represented in detail by FIGS. 1 to 13 and 17 and 18 of the drawings. The honeycomb cellular reflector 10 includes a honeycomb cell structure 20 having a plurality of connected cells 22 therein, as shown in FIG. 1. Cells 22 are hollow with internal passageways 22*a* and are in the shape of hexagons. Each of the connected cells 22 include integrally connected reflective walls 24*a*, 24*b*, 24*c*, 24*d*, 24*e* and 24*f*. Openings 22*b* and 22*c* are at each end of each cell 22 with the openings 22*b* being on the viewing side of the honeycomb cell structure 20, and openings 22*c* being on the light-receiving side of the honeycomb cell structure 20. The cells 22 may be of any suitable shape, such as triangular, square, rectangular, hexagonal, octagonal, decagonal, polygonal or the like. The alternate embodiments 100, 200 and 300 use honeycomb cell structures 120, 220, 320 where each cell 122, 222 and 322 may have different cell shapes such as triangular, rectangular and octagonal, as shown in FIGS. 14, 15 and 16, respectively.

In the preferred embodiment 10, cells 22 of the honeycomb cell structure 20 are hexagonal in shape, are formed of aluminum walls 24*a* to 24*f* and have a highly reflective internal finish. Additionally, honeycomb cell structure 20 may be made of NOMEX, plastic, coated paper, steel or stainless steel, and the internal reflective walls 24*a* to 24*f* may be coated with a reflective or luminous material 26, such as phosphor, phosphorous compounds, iridescent particles, reflective color compositions being red, blue and green in color, pearlescent particles, highly reflective metalized compositions being specular, diffusing, or translucent, and combinations thereof. Further, the size of the cells 22 of the honeycomb cell structure 20 may be changed to provide more control 15, of the light pattern 12. The honeycomb cell structure 20 can be formed in various shapes and configurations selected from the group consisting of a triangle, a square, a rectangle, a circle, an oval, an ellipse, a pentagon, a hexagon, a heptagon, an octagon, a decagon or a polygon.

Figure 12:
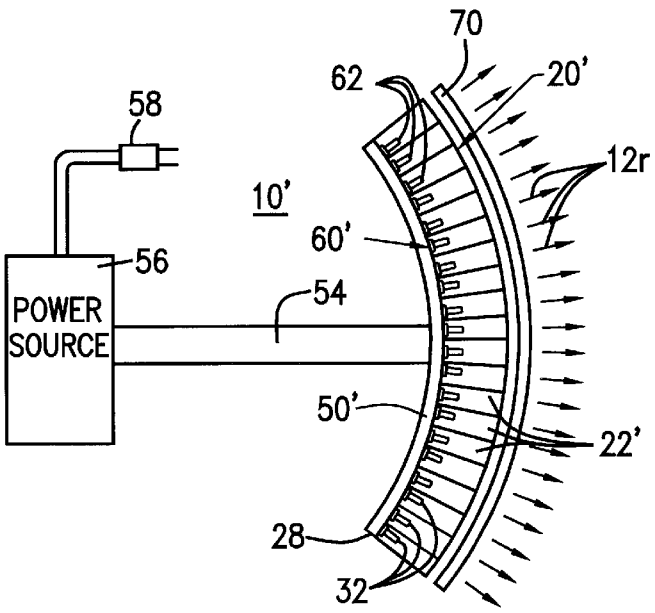
FIG. 12 is a cross-sectional view of the honeycomb cellular reflector of the present invention showing the power supply, the electrical PC mounting board, the adjuster plate, the plurality of LEDs, the honeycomb cell structure with radial cells and a curved shaped lens cover for use in a curved cellular reflector.
Figure 13:
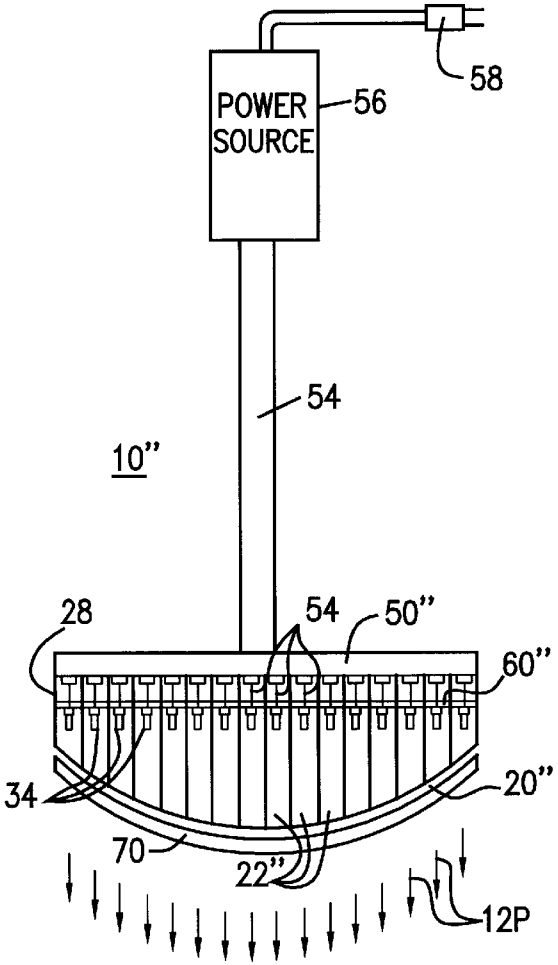
FIG. 13 is a cross-sectional view of the honeycomb cellular reflector of the present invention showing the power supply, the electrical PC mounting board, the adjuster plate, the plurality of LEDs, the honeycomb cell structure with parallel cells and a curved shaped lens cover for use in a curved cellular reflector.

The honeycomb cell structures 20' and 20", as shown in FIGS. 12 and 13, show the honeycomb cellular reflectors 10' and 10", respectively, being curved in shape and having an arc configuration that is circular, oval or elliptical. Honeycomb cell structure 20' includes a plurality of radial cells 22*r* where light exits the radial cells 22*r* of the honeycomb cell structure 20' in a divergent light pattern 12*r* having a curved shape, as shown in FIG. 12 of the drawings. Honeycomb cell structure 20" includes a plurality of parallel cells 22*p* where light exits the parallel cells 22*p* of the honeycomb cell structure 20" in a parallel and straight light pattern 12*p*, as shown in FIG. 13 of the drawings, regardless of the curved shape of the opening 22*b"* being the viewing side of cell structure 20".

Figure 2:
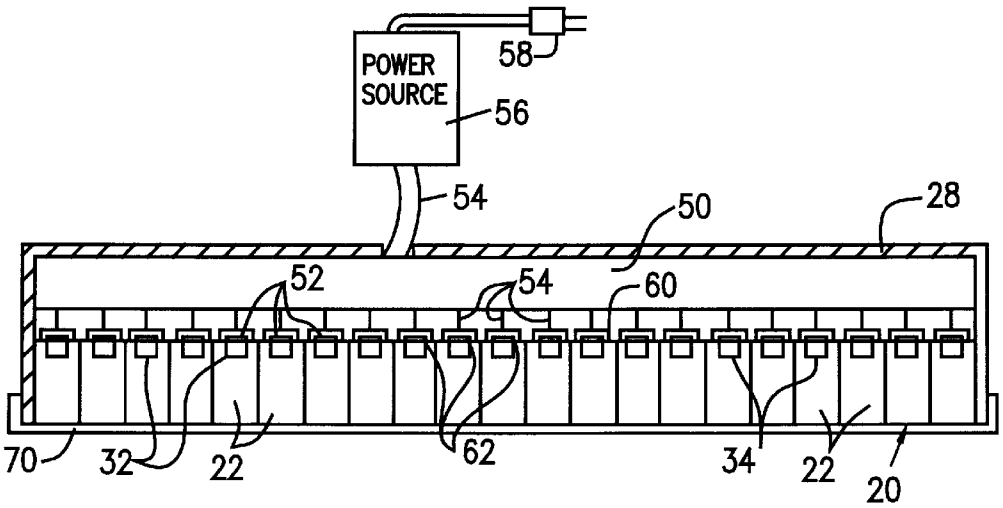
FIG. 2 is a cross-sectional view of the honeycomb cellular reflector of the present invention showing the power supply, the electrical PC mounting board, the depth control adjuster plate, the plurality of light emitting diodes or laser diodes, the honeycomb cell structure and the lens cover, all within a housing.
Figure 6:
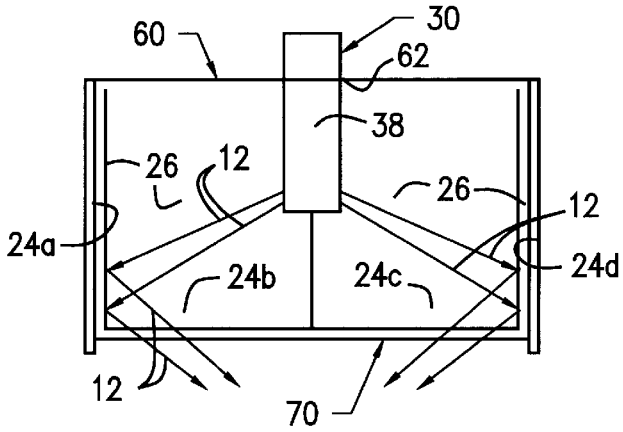
FIG. 6 is a cross-sectional view of the honeycomb cellular reflector of the present invention taken along lines 6—6 of FIG. 5 showing an individual honeycomb cell with coated reflective cell walls having a single internal light source therein, and a lens cover thereon.

The plurality of light sources 30 are movably mounted within cells 22, 22' and 22", or are positioned behind the cells on the light-receiving side, so that the position of the light sources or their depth of insertion of the light sources 30 into the plurality of cell passageways 22*a*, 22*a'* and 22*a"* of cells 22, 22' and 22", respectively, may be adjusted for controlling the amount and pattern of light 12, 12*r* and 12*p* reflected from reflective walls 24*a* to 24*f* of cells 22, 22' and 22", as shown in FIGS. 6, 12 and 13 of the drawings. The light sources 30 are movably mounted within cells 22, 22' and 22" to change their depth and/or angle by means of a depth control adjuster plate 60 or 60' having openings 62 therein, for receiving the plurality of light sources 30 within openings 62, as shown in FIGS. 2, 12 and 13 of the drawings. The light sources 30 within openings 62 of the depth control adjuster plate 60 or 60' are electrically connected to the electrical PC mounting board 50 or 50' via electrical lines 54. Thus, as the depth control adjuster plate 60 or 60' is moved inwardly to the light-receiving side openings 22*c*, 22*c'* or 22*c"*, or moved outwardly to the viewing side openings 22*b*, 22*b'* or 22*b"*, the depth of insertion of the plurality of light sources 30 within cells 22, 22' and 22" are adjusted. By making such adjustments, the pattern of light 12, 12*r* and 12*p* coming out of the viewing sides 22*b*, 22*b'* and 22*b"* of cell structures 20, 20' and 20", respectively, may be varied.

Alternatively, light sources 30 may be mounted behind the cells on the light-receiving side and moved relative to the cells to change the amount and pattern of light reflected from the cells, by changing the angle and/or location of light sources 30 relative to the cells.

The adjuster plates 60 and 60' are made of plastic or metal having the plurality of openings 62 therein for receiving the light sources 30 within openings 62, such that the light sources 30 are fixed to the adjuster plate 60 or 60' so as to move with the adjuster plate 60 when it moves inwardly or outwardly. The pattern of openings 62 in the adjuster plate 60 matches the layout and pattern of cells 22, 22' and 22", such that openings 62 and cells 22, 22' and 22" are in alignment with each other. Thus, as the depth control adjuster plate 60 and 60' is moved inwardly or outwardly, the adjuster plate 60 and 60' changes the depth of insertion of light sources 30 in the respective cells 22, 22' and 22".

Figure 3:
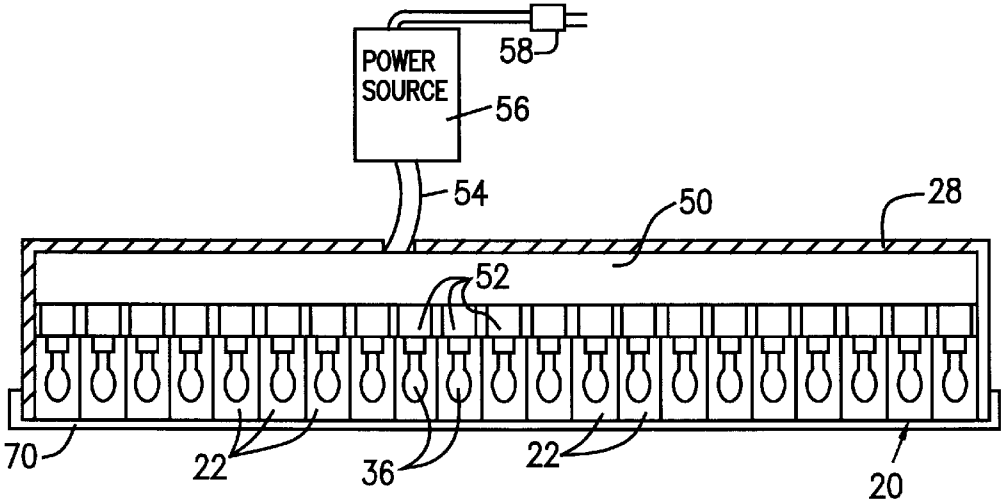
FIG. 3 is a cross-sectional view of the honeycomb cellular reflector of the present invention showing the electrical PC mounting board having socket receptacles therein, the plurality of incandescent light bulbs, the honeycomb cell structure and the lens cover, all within a housing.
Figure 4:
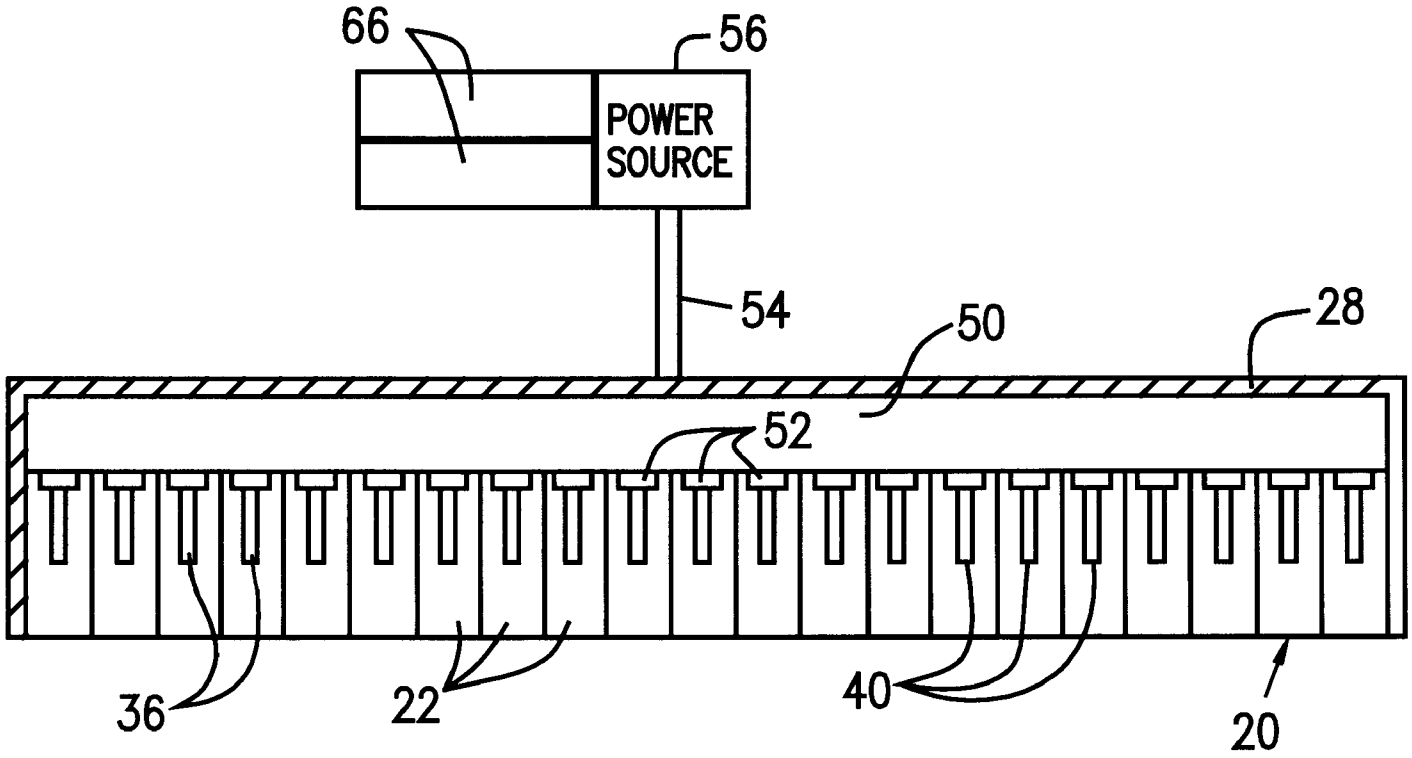
FIG. 4 is a cross-sectional view of the honeycomb cellular reflector of the present invention showing the power supply of batteries, the electrical PC mounting board having socket receptacles therein, the plurality of fluorescent or neon light bulbs, the honeycomb cell structure and the lens cover, all within a housing.

When the depth control adjuster plate 60 is not included in the cellular reflector 10, as shown in FIGS. 3 and 4 of the drawings, the electrical PC mounting board 50 includes a plurality of sockets or receptacles 52 therein for receiving various light sources 30 such as LEDs 32, laser diodes 34, incandescent light bulbs 36, fluorescent light bulbs 38, neon lamp bulbs 40, high intensity light bulbs 42 or halogen bulbs 44.

As shown in FIGS. 5, 6, 12 and 13, honeycomb cell structure 20, 20' or 20" may be formed of NOMEX, which is made coated paper with a vacuum metalized reflective finish and is bendable or curvable, so that the pattern of light 12, 12*r* and 12*p* may be varied.

Figure 7:
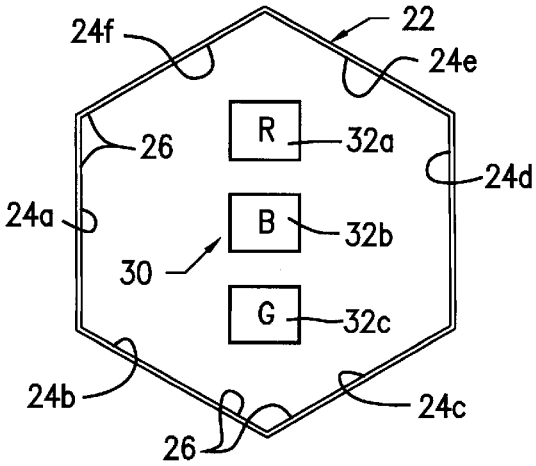
FIG. 7 is a front elevational view of the honeycomb cellular reflector of the present invention showing an individual honeycomb cell with coated reflective walls and having LEDs therein for producing red, blue and green light beams.

As shown in FIG. 7, three or more light sources 30 being LEDs 32*a*, 32*b* and 32*c* are mounted within the same cell passageway 22*a* of cell 22. The LED light source 32*a*, 32*b* and 32*c* can provide the three primary colors of red, blue and green of LEDs 32*a*, 32*b* and 32*c*, respectively, within each of the cell passageways 22*a* of cells 22. By changing the mix of the three primary colors, any desired color may be obtained and reflected off of the coated reflective material 26 from the internal reflective walls 24*a* to 24*f*. As shown in FIG. 7, two or more LEDs 32*a* to 32*c* may also be mounted within each cell passageway 22*a* (LEDs 32*a* to 32*c* do not have a color) of cell 22 for providing an increased intensity of light coming out of cell 22 when in operational use.

The present invention shows the honeycomb cellular reflector 10 having various modified preferred embodiments as demonstrated in FIGS. 2, 3, 4, 12 and 13 of the drawings. As shown in FIG. 2, the honeycomb cellular reflector 10 includes a power supply 56 electrically connected to an electrical PC mounting board 50 via electrical plug 58, a depth control adjuster plate 60 having a plurality of openings 62 therein for receiving a plurality of light emitting diodes 32 or laser diodes 34 within a plurality of connected cells 22 of honeycomb cell structure 20, and an optional lens cover 70. All of the component parts are located and secured within a housing 28.

As shown in FIG. 3, the honeycomb cellular reflector 10 includes an electrical PC mounting board 50 having socket receptacles 52 therein for receiving a plurality of incandescent light bulbs 36 within socket receptacles 52, and incandescent light bulbs 36 are received within a plurality of connected cells 22 of honeycomb cell structure 20, having a lens cover 70. All of the component parts are located and secured within a housing 28.

As shown in FIG. 4, the honeycomb cellular reflector 10 includes a power supply 56 having batteries 66 therein being electrically connected to an electrical PC mounting board 50 having socket receptacles 52 therein via electrical line 68. Socket receptacles 52 are used for receiving a plurality of fluorescent bulbs 38 or neon light bulbs 40 within a plurality of connected cells 22 of honeycomb cell structure 20. All of the component parts are located and secured within a housing 28.

As shown in FIG. 12, the honeycomb cellular reflector 10' is curved and includes a power supply 56 being electrically connected to an electrical PC mounting board 50' having a curved shape via electrical plug 58; a depth control adjuster plate 60' having a plurality of openings 62 therein for receiving a plurality of LEDs 32 within openings 62; and the LEDs 32 are received within a plurality of connected cells 22' of honeycomb cell structure 20'. All of the component parts are located and secured within a housing 28.

As shown in FIG. 13, the honeycomb cellular reflector 10" is curved and includes a power supply 56 being electrically connected to an electrical PC mounting board 50" via electrical plug 58, a depth control adjuster plate 60" having a plurality of openings 62 therein for receiving a plurality of laser diodes 34 within a plurality of connected cells 22" of honeycomb cell structure 20". All of the component parts are located and secured within a device housing 28.

Figure 17:
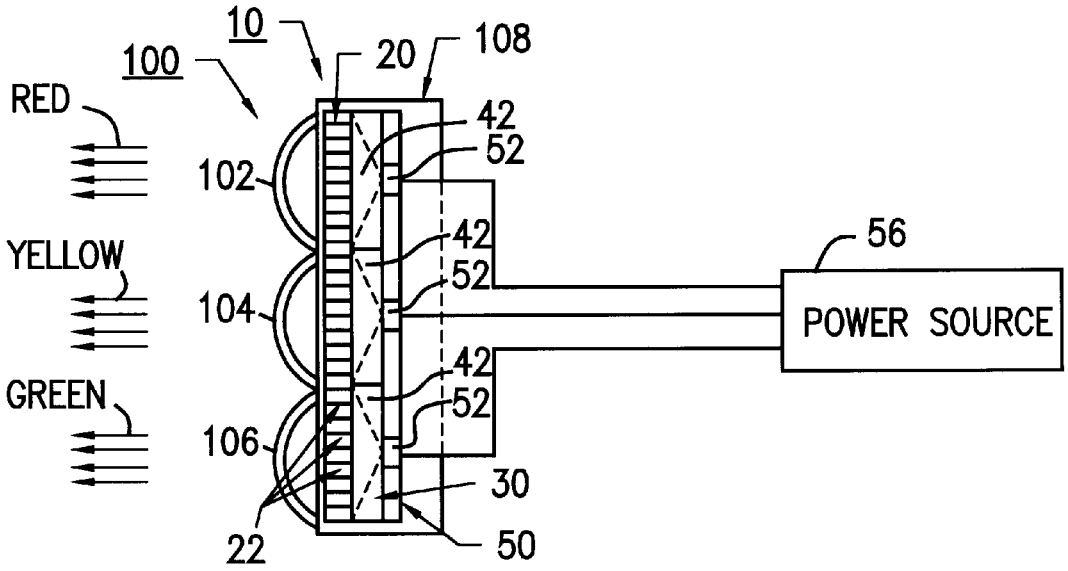
FIG. 17 is a cross-sectional view of the honeycomb cellular reflector of the present invention showing the power source, the electrical lines, the electrical PC mounting board having sockets, the plurality of high intensity light bulbs, the honeycomb cell structure and the colored lens within a housing component being used as part of a traffic signal light.
Figure 18:
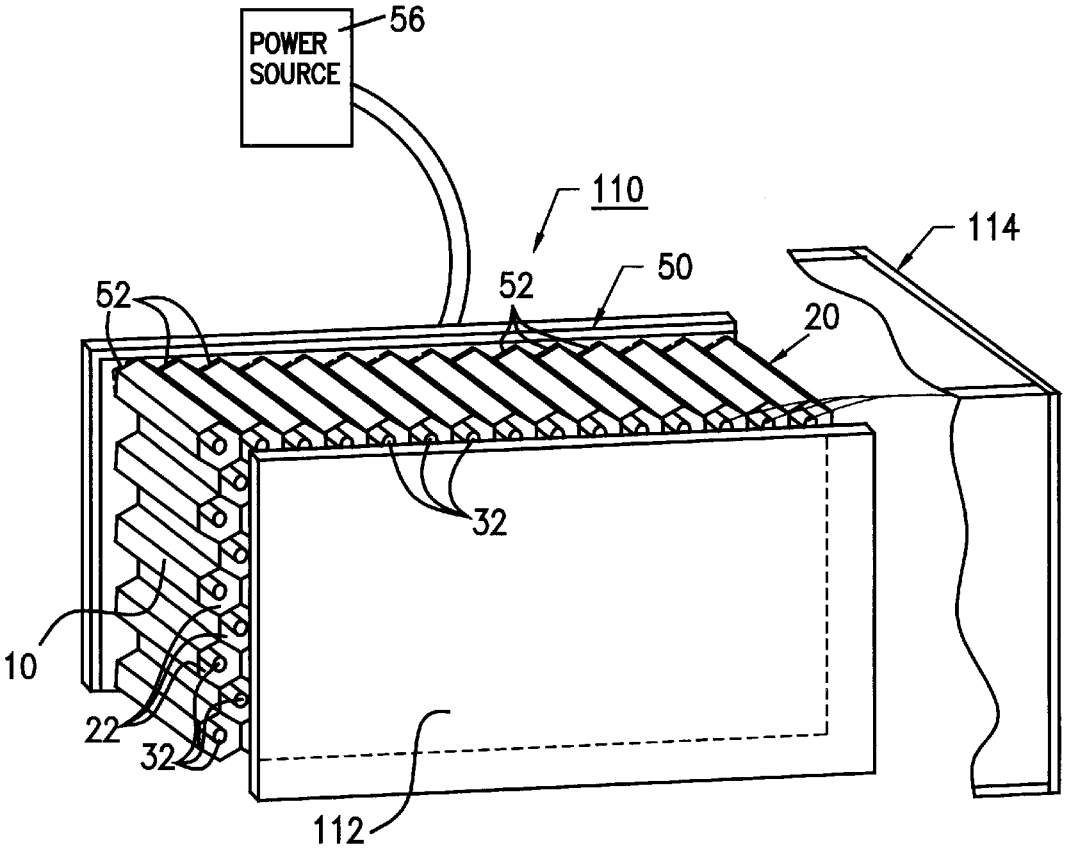
FIG. 18 is a front exploded perspective view of the honeycomb cellular reflector of the present invention showing the power source, the electrical PC mounting board with receptacles therein, the plurality of LEDs, the honeycomb cell structure, and the lens cover within a housing component being used as part of an automobile lighting device.

The honeycomb cellular reflectors 10, 10' and 10" of the preferred embodiments of the present invention have numerous applications, as shown in FIGS. 8 to 11 and 17 and 18 of the drawings, such as in road-sign lighting fixtures 80, lighting fixtures 84 for general illumination, televisions 90, photocopying machines 94, and traffic signal lights 100. The honeycomb cellular reflectors 10, 10' and 10" of the present invention also have automotive applications 110, as shown in FIG. 18, and can be used as part of an automobile headlamp, an automobile reflector marker, a dome light fixture, a taillight, or a brake light. Other lighting applications for the present invention can include highway, street and sidewalk overhead lamps; VDT displays; flash lights; photolithography machines; video arcade machines; and portable emergency lights.

Figure 8:
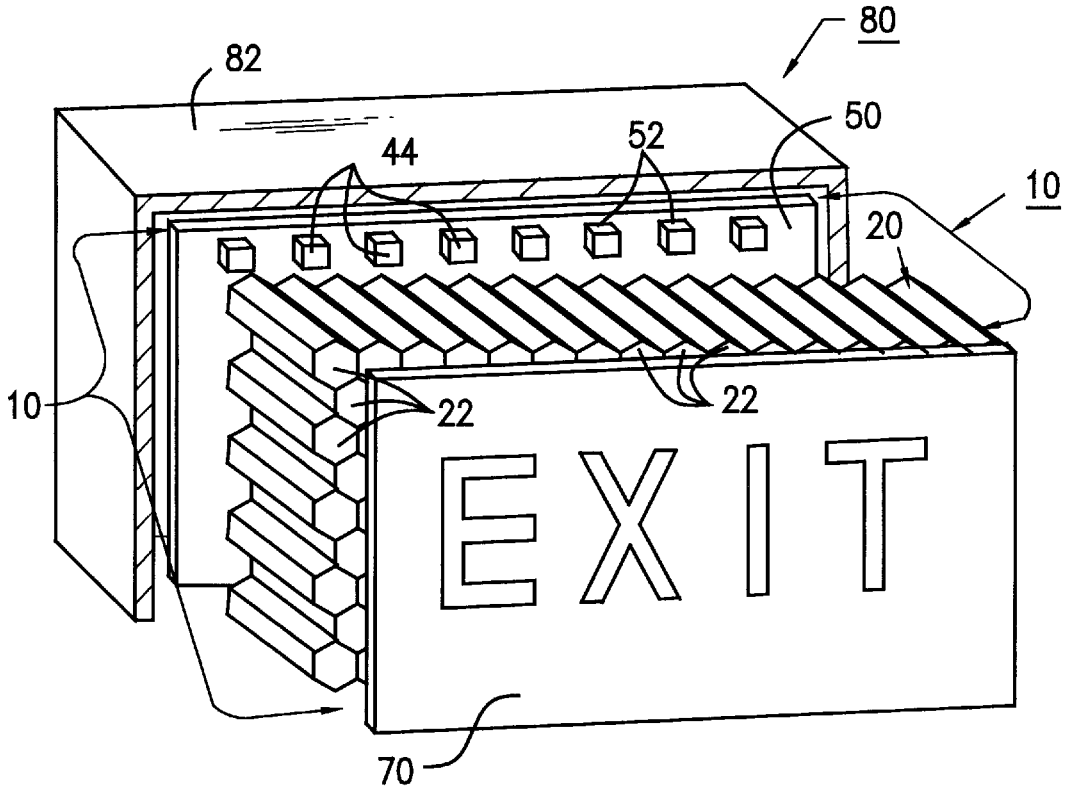
FIG. 8 is a front exploded perspective view of the honeycomb cellular reflector of the present invention showing the electrical PC mounting board, the plurality of halogen light bulbs, the honeycomb cell structure, the lens cover within a housing component being used as part of a road sign or a road-sign lighting fixture.

As shown in FIG. 8, item 80 represents a road-sign lighting fixture employing the present invention. The road-sign lighting fixture 80 includes an electrical PC mounting board 50 having sockets/receptacles 52 therein for receiving a plurality of halogen light bulbs 44 therein; wherein the plurality of halogen lightbulbs 44 are received within a plurality of connected cells 22 of honeycomb cell structure 20. All of the component parts of the honeycomb cellular reflector 10 are located and secured within a housing component 82 which is used as part of the road-sign lighting fixture 80.

Figure 9:
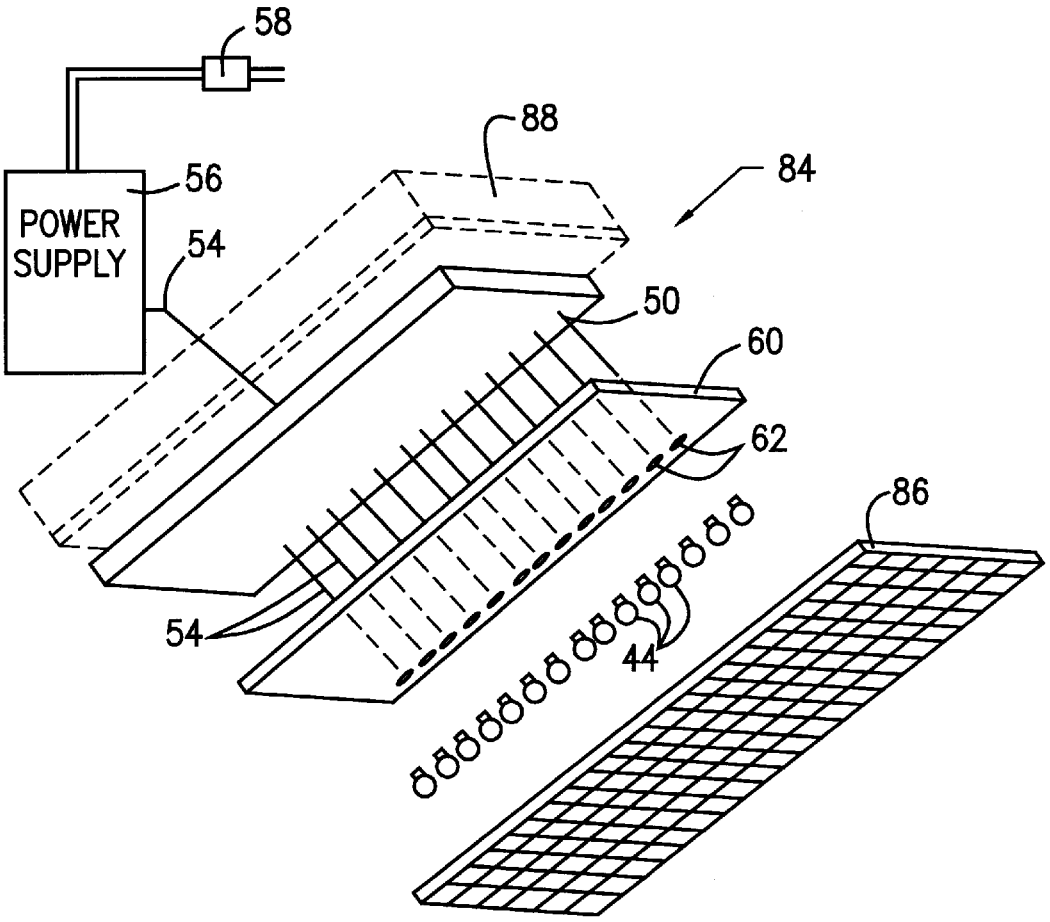
FIG. 9 is a front exploded perspective view of the honeycomb cellular reflector of the present invention showing the power supply, the electrical PC mounting board, the depth control adjuster plate, the plurality of high intensity light bulbs, the honeycomb cell structure, and the diffuser within a housing component being used as part of a lighting fixture for general illumination or a street lamp.

As shown in FIG. 9, item 84 represents a lighting fixture for general illumination which employs the honeycomb cellular reflector 10 of the present in invention. The lighting fixture 84 includes a power supply 56 being electrically connected to an electrical PC mounting board 50 via electrical plug 58; a depth control adjuster plate 60 having a plurality of openings 62 therein for receiving a plurality of high intensity light bulbs 42 within openings 62; the HIL bulbs 42 are received within a plurality of connected cells 22 of honeycomb cell structure 20; and a diffuser component 86. All of the component parts of the honeycomb cellular reflector 10 are located and secured within a housing 88 which is used as part of the lighting fixture 84.

Figure 10:
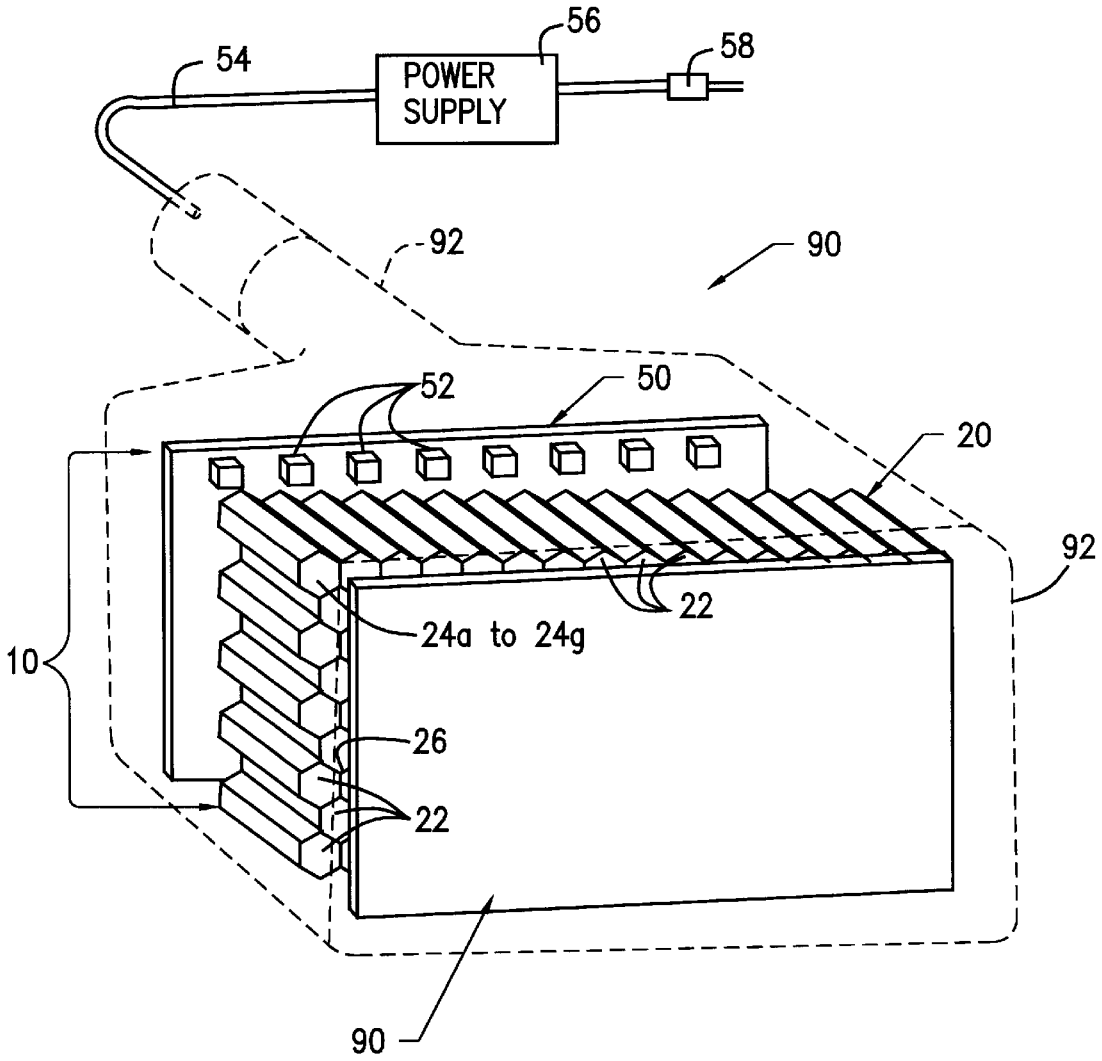
FIG. 10 is a front exploded perspective view of the honeycomb cellular reflector of the present invention showing the electrical PC mounting board, the plurality of LEDs, the honeycomb cell structure and the TV screen lens within a television tube being used as part of a television or a VDT display.

As shown in FIG. 10, item 90 represents a television screen which employs the honeycomb cellular reflector 10 of the present invention. The television screen 90 includes a power supply 56 being electrically connected to an electrical PC mounting board 50 having receptacles 52 therein via electrical plug 58; receptacles 52 are used for receiving a plurality of LEDs 32 within receptacles 52; the plurality of LEDs 32 are received within a plurality of connected cells 22 having a phosphorous coating 26 on the internal walls 24*a* to 24*f* of the honeycomb cell structure 20; and a TV tube housing 92. All of the component parts of the honeycomb cellular reflector 10 are located and secured within the TV housing 92.

Figure 11:
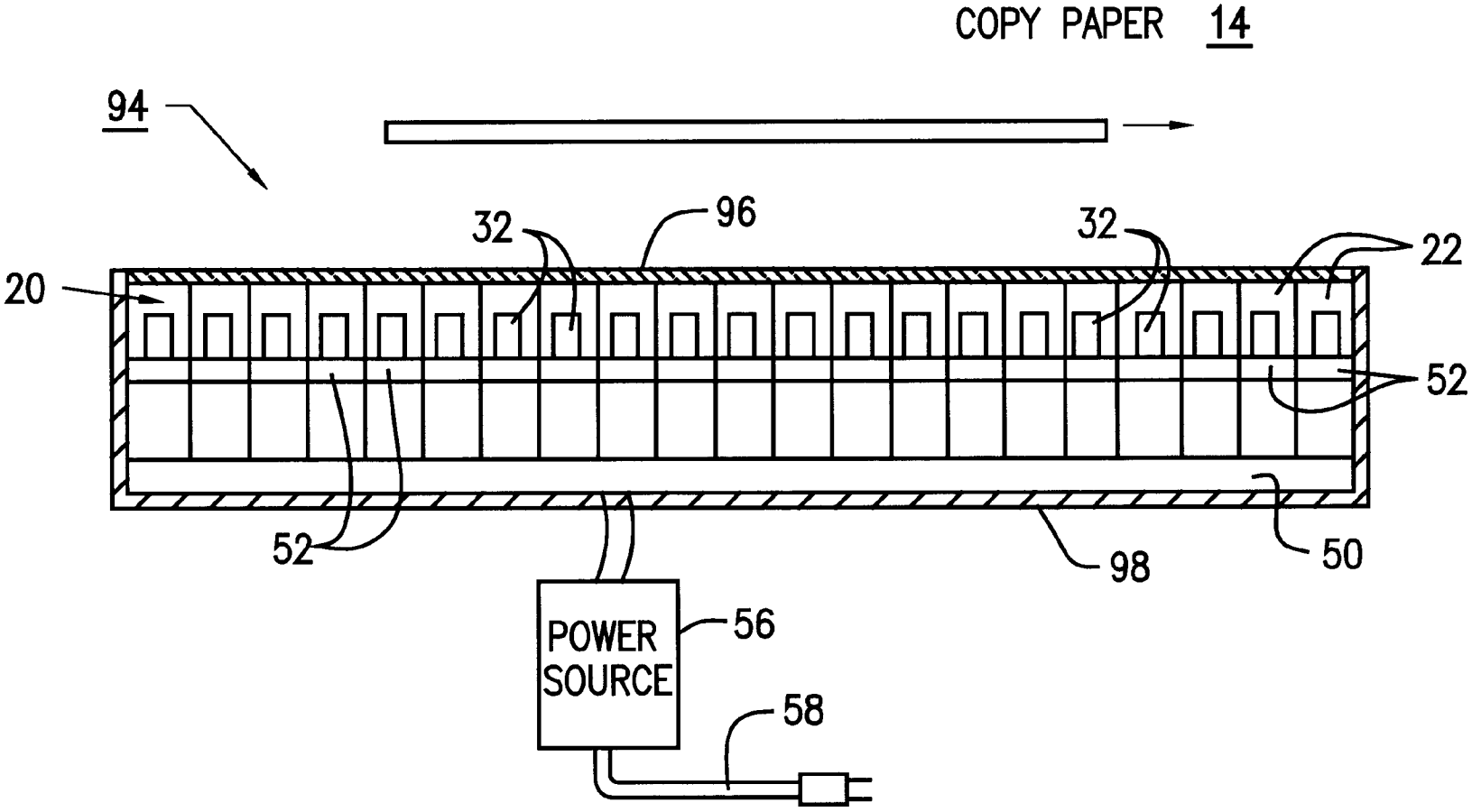
FIG. 11 is a front perspective view of the honeycomb cellular reflector of the present invention showing the power supply, the electrical PC mounting board, the plurality of LEDs, the honeycomb cell structure and the glass lens, within a housing being used as part of a photocopying machine or a photolithography machine.

As shown in FIG. 11, item 94 represents a photocopying machine which employs the honeycomb cellular reflector 10 of the present invention. The photocopying machine 94 includes a power supply 56 being electrically connected to an electrical PC mounting board 50 having receptacles 52 therein via electrical plug 58; receptacles 52 are used for receiving a plurality of LEDs 32 within receptacles 52; the plurality of LEDs 32 are received within a plurality of connected cells 22 of the honeycomb cell structure 20; and a glass cover 96 for holding and photocopying of a sheet of paper 14 having indicia thereon. All of the component parts of the honeycomb cellular reflector 10 are located and secured within a housing 98 which forms a part of the photocopying machine 94.

As shown in FIG. 17, item 100 represents a traffic signal light which employs the honeycomb cellular reflector 10 of the present invention. The traffic signal light 100 includes a power source 56 being electrically connected to an electrical PC mounting board 50 having sockets 52 therein for receiving a plurality of HIL bulbs 42; the plurality of HIL bulbs 42 transmits light within the plurality of connected cells 22 of the honeycomb structure 20, and a plurality of colored lenses 102, 104 and 106 attached to the plurality of connected cells 22 of the honeycomb structure 20. Colored lenses 102, 104 and 106 transmit red, yellow and green light, respectively, from traffic signal light 100. All of the component parts of the honeycomb cellular reflector 10 are located and secured within the traffic light housing 108.

As shown in FIG. 18, item 110 represents various automobile devices in the form of an automobile headlight, an automobile reflector marker, a dome light fixture, a taillight or a brake light which employs the honeycomb cellular reflector 10 of the present invention. The automotive device 110 includes a power source 56 being electrically connected via electrical lines 105 to an electrical PC mounting board 50 having receptacles 52 therein for receiving a plurality of LEDs 32 within receptacles 52; the plurality of LEDs 32 are received within a plurality of connected cells 22 of the honeycomb structure 20; and a lens cover 112 for transmitting color light rays (i.e. red for a brake light) or colorless light rays (i.e. for a headlamp). All of the component parts of the honeycomb cellular reflector 10 are located and secured within a housing 114 which forms part of the automotive device 110.

DETAILED DESCRIPTION OF THE ALTERNATE EMBODIMENTS 100, 200 AND 300

As shown in FIG. 14, the honeycomb cellular reflector 100 of the first alternate embodiment of the present invention includes a honeycomb cell structure 120 having a plurality of connected cells 122 therein. Each of the connected cells 122 include integrally connected internal reflective walls 124*a*, 124*b* and 124*c*. Cells 122 are hollow with internal passageways 122*a* and are in the shape of triangles. Openings 122*b* and 122*c* are at each end of each cell 122 with the opening 122*b* being on the viewing side of the honeycomb cell structure 120, and openings 122*c* being on the light-receiving side of the honeycomb cell structure 120. Further, the size of the cells 122 of honeycomb cell structure 120 may be changed to provide more control of the light pattern 12. In all other respects, the honeycomb cellular reflector 100 of the first alternate embodiment operates and functions in the same manner as the honeycomb cellular reflector 10 of the preferred embodiment.

As shown in FIG. 15, the honeycomb cellular reflector 200 of the second alternate embodiment of the present invention includes a honeycomb cell structure 220 having a plurality of connected cells 222 therein. Each of the connected cells 222 include integrally connected internal reflective walls 224*a*, 224*b*, 224*c* and 224*d*. Cells 222 are hollow with internal passageways 222*a* and are in the shape of rectangles. Openings 222*b* and 222*c* are at each end of each cell 222 with the opening 222*b* being on the viewing side of the honeycomb cell structure 220, and openings 222*c* being on the light-receiving side of the honeycomb cell structure 220. Further, the size of the cells 222 of honeycomb cell structure 220 may be changed to provide more control of the light pattern 12. In all other respects the honeycomb cellular reflector 200 of the second alternate embodiment operates and functions in the same manner as the honeycomb cellular reflector 10 of the preferred embodiment.

As shown in FIG. 16, the honeycomb cellular reflector 300 of the third alternate embodiment of the present invention includes a honeycomb cell structure 320 having a plurality of connected cells 322 therein. Each of the connected cells 322 include integrally connected internal reflective walls 324*a*, 324*b*, 324*c*, 324*d*, 324*e*, 324*f*, 324*g* and 324*h*. Cells 322 are hollow with internal passageways 322*a* and are in the shape of octagons. Openings 322*b* and 322*c* are at each end of each cell 322 with the openings 322*b* being on the viewing side of the honeycomb cell structure 320, and openings 322*c* being on the light-receiving side of the honeycomb cell structure 320. Further, the size of the cells 322 of honeycomb cell structure 320 may be changed to provide more control of the light pattern 12. In all other respects the honeycomb cellular reflector 300 of the third alternate embodiment operates and functions in the same manner as the honeycomb cellular reflector 10 of the preferred embodiment.

OPERATION OF THE PREFERRED INVENTION

Figure 5:
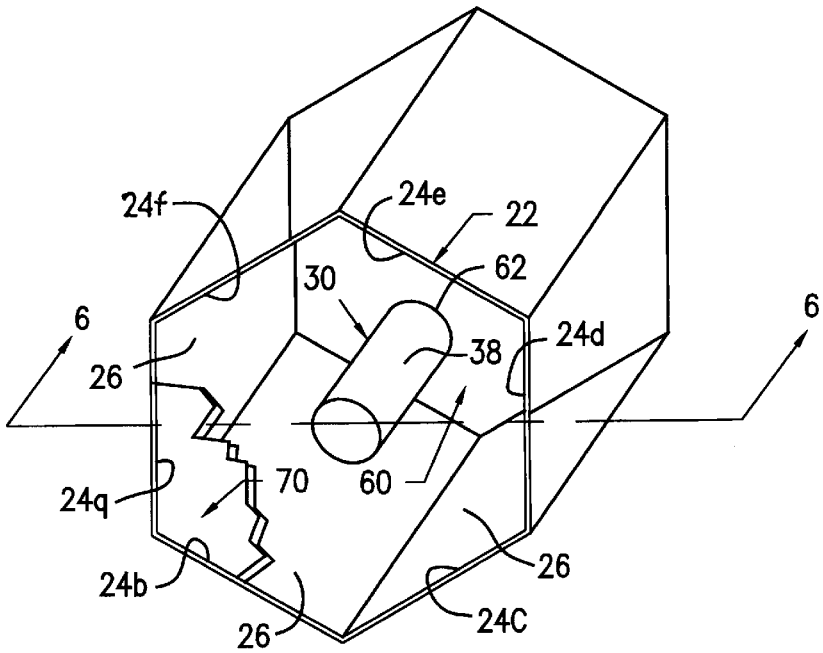
FIG. 5 is a front perspective view of the honeycomb cellular reflector of the present invention showing an individual honeycomb cell with coated reflective cell walls having a single internal light source therein, and a lens cover thereon.

In operation of the preferred and alternate embodiments of the honeycomb cellular reflectors 10, 10', 10", 100, 200 and 300, as shown in FIGS. 2 through 16 of the drawings, all of the aforementioned honeycomb cellular reflectors function and operate in a similar manner to produce a specific light pattern 12, 12*r*, or 12*p*. To produce a given light pattern 12, the light source 30 is turned on via power supply 56 or batteries 66. Then a specific type of light producing devices 30, such as LEDs 32, laser diodes 34, incandescent light bulbs 36, fluorescent light bulbs 38, neon lamps 40, high intensity light bulbs 42 or halogen bulbs 44 are received within an electrical PC mounting board 50 having a plurality of receptacles or sockets 52 therein. The light producing devices 30 are then received within a plurality of connected cells 22, 22', 22", 122, 222 and 322 of honeycomb cell structures 20, 20', 20", 120, 220 and 320, respectively or are placed behind the cells. For example, as shown in FIG. 5 and 6 of the drawings, the light reflected from the coated reflective material 26 of reflective cell walls 24*a* to 24*f* produced by the fluorescent light bulbs 38 is focused through the internal passageway 22*a* of cell 22 such that the light pattern 12 produced by those reflective coated walls 26*a* to 26*f* produces a specific light pattern 12 from cell opening 22*b*. In this manner, by changing the angle and/or location of the light-producing devices, the specific light pattern 12 may be changed and used in various lighting applications, as previously mentioned.

The honeycomb cellular reflectors 10, 10', 10", 100, 200 and 300 may also include the use of depth control adjuster plates 60 or 60' having openings 62 therein in conjunction with the electrical PC mounting boards 50 or 50', as shown in FIGS. 2, 9, 12 and 13. The depth control adjuster plates 60 or 60' may be moved inwardly to the light-receiving side of openings 22*c*, 22*c'* or 22*c"* or moved outwardly to the viewing side of openings 22*b*, 22*b'* or 22*b"*, such that the depth of insertion of light sources 30 within passageways 22*a*, 22*a'* or 22*a"* are adjustable to produce a specific light pattern 12, 12*r* or 12*p*. In making such adjustments, the pattern of light 12, 12*r* and 12*p* produced by the cell structures 20, 20' and 20", respectively, may be varied to provide the viewer or user with the proper amount of light for the lighting applications previously mentioned.

ADVANTAGES OF THE PRESENT INVENTION

Accordingly, an advantage of the present invention is that it provides for a honeycomb cellular reflector in combination with various internal light sources in order to optimize the light output and to provide new applications using the honeycomb cellular reflector.

Another advantage of the present invention that it provides for a honeycomb cellular reflector for use with various internal light sources for controlling and focusing divergent light in an efficient manner in order to narrow or widen the beam or pattern of light coming from the plurality of connected cells of the honeycomb cell structure.

Another advantage of the present invention is that it provides for a honeycomb cellular reflector that has a variety of individual cellular structures including triangles, squares, rectangles, octagons and other polygon configurations.

Another advantage of the present invention is that it provides for a honeycomb cellular reflector with internal light sources to produce new applications for use as signs, car head lamps, overhead street lamps, traffic signal lights, television screens, photocopying devices, photolithography devices, VDT displays and the like.

A further advantage of the present invention is that it provides for a honeycomb cellular reflector with internal light source that can be mass produced in an automated and economical manner and is readily affordable by the manufacturer.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A cellular reflector for producing a pattern of light, comprising:

a) a honeycomb structure including a plurality of connected cells, wherein each of said connected cells has depth;

b) a plurality of light sources for producing light within a selected plurality of said connected cells;

c) means for connecting said plurality of light sources to a power supply;

d) each of said connected cells having reflective walls for reflecting light from said plurality of light sources to produce the pattern of light; and e) control means for adjusting the position of said plurality of said light sources relative to said plurality of connected cells for controlling the pattern of light reflected from said reflective walls of said selected plurality of connected cells.

2. A cellular ref lector in accordance with claim 1, wherein at least one of said plurality of light sources are mounted within each of said selected plurality of said connected cells.

3. A cellular ref lector in accordance with claim 1, wherein said plurality of light sources are mounted outside of said selected plurality of said connected cells, to project light into said cells.

4. A cellular reflector in accordance with claim 1, wherein said control means adjusts the depth and/or angle of said light sources in said cells for changing the pattern of light reflected from said reflective walls.

5. A cellular reflector in accordance with claim 1, wherein said control means adjusts the spacing and/or angle of said light sources relative to said cells for changing the pattern of light reflected from said reflective walls.

6. A cellular reflector in accordance with claim 1, wherein each of said connected cells has a hexagonal shape.

7. A cellular reflector in accordance with claim 1, wherein each of said connected cells has a polygonal shape.

8. A cellular reflector in accordance with claim 1, wherein each of said connected cells is formed in a shape selected from the group consisting of a triangle, a square, a rectangle, an octagon and decagon.

9. A cellular reflector in accordance with claim 1, wherein said honeycomb cell structure is formed of materials selected from the group consisting of NOMEX, plastic, coated paper, steel and stainless steel.

10. A cellular reflector in accordance with claim 1, wherein said honeycomb cell structure is formed of aluminum and has a highly reflective finish.

11. A cellular reflector in accordance with claim 1, wherein said honeycomb cell structure is in a curved shape being circular, oval or elliptical.

12. A cellular reflector in accordance with claim 1, where said honeycomb cell structure is formed in a shape selected from the group consisting of a triangle, a square, a rectangle, a circle, an oval, an ellipse, a pentagon, a hexagon, a heptagon, an octagon, a decagon and a polygon.

13. A cellular reflector in accordance with claim 1, wherein said control means is a depth control adjuster in the form of a plate having holes therein for receiving said plurality of internal light sources.

14. A cellular reflector in accordance with claim 13, wherein said holes of said depth control adjuster are in alignment with said cells in said honeycomb cell structure.

15. A cellular reflector in accordance with claim 1, wherein said means for connecting includes an electrical PC mounting board having a plurality of receptacles or sockets for said plurality of light sources being used.

16. A cellular reflector in accordance with claim 1, wherein said plurality of light sources are light-producing devices selected from the group consisting of incandescent bulbs, high intensity light bulbs, fluorescent bulbs, neon lamps, light emitting diodes (LEDs) and laser diodes.

17. A cellular reflector in accordance with claim 1, wherein said selected plurality of connected cells each have mounted therein at least two of said plurality of light sources.

18. A cellular reflector in accordance with claim 1, wherein said selected plurality of connected cells each have mounted therein at least three (3) of said plurality of said light sources.

19. A cellular reflector in accordance with claim 1, wherein said reflective walls are coated with a reflective material.

20. A cellular reflector in accordance with claim 19, wherein said reflective material is selected from the group consisting of phosphor, phosphorous compounds, iridescent particles, reflective color compositions being red, blue and green in color, pearlescent particles, highly reflective metalized compositions, and combinations thereof.

21. A cellular reflector in accordance with claim 1, wherein said cellular reflector is used as part of a traffic signal light.

22. A cellular reflector in accordance with claim 1, wherein said cellular reflector is used as part of an overhead street lamp.

23. A cellular reflector in accordance with claim 1, wherein said cellular reflector is used as part of a television screen.

24. A cellular reflector in accordance with claim 1, wherein said cellular reflector is used as part of a VDT display.

25. A cellular reflector in accordance with claim 1, wherein said cellular reflector is used as part of an automobile light.

26. A cellular reflector in accordance with claim 25, wherein said automobile light is in the form of a automobile marker light, a taillight, a brakelight or a dome light.

27. A cellular reflector in accordance with claim 1, wherein said cellular reflector is used as part of an automobile headlamp.

28. A cellular reflector in accordance with claim 1, wherein said cellular reflector is used as part of a roadway lighting sign.

29. A cellular reflector in accordance with claim 1, wherein said cellular reflector is used as part of a roadway lighting fixture.

30. A cellular reflector in accordance with claim 1, wherein said cellular reflector is used as part of a lighting fixture for general illumination.

31. A cellular reflector in accordance with claim 1, wherein said cellular reflector is used as part of a lighting fixture for a photolithography apparatus.

32. A cellular reflector in accordance with claim 1, wherein said cellular reflector is used as part of a lighting fixture for photocopying machines.

33. A cellular reflector for producing a pattern of light, comprising:

a) a honeycomb cell structure including a plurality of connected cells, wherein each of said connected cells has depth;

b) a plurality of light sources for producing light within a selected plurality of said connected cells;

c) means for connecting said plurality of light sources to a power supply; and d) each of said connected cells having reflective walls for reflecting light from said plurality of light sources to produce the pattern of light.

34. A cellular reflector in accordance with claim 33, wherein at least one of said plurality of light sources are mounted within each of said selected plurality of said connected cells.

35. A cellular reflector in accordance with claim 33, wherein said plurality of light sources are mounted outside of said selected plurality of said connected cells, to project light into said cells.

36. A cellular reflector in accordance with claim 33, wherein each of said connected cells has a hexagonal shape.

37. A cellular reflector in accordance with claim 33, wherein each of said connected cells has a polygonal shape.

38. A cellular reflector in accordance with claim 33, wherein each of said connected cells is formed in a shape selected from the group consisting of a triangle, a square, a rectangle, an octagon and a decagon.

39. A cellular reflector in accordance with claim 33, wherein said honeycomb cell structure is formed of materials selected from the group consisting of NOMEX, plastic, coated paper, steel, and stainless steel.

40. A cellular reflector in accordance with claim 33, wherein said honeycomb cell structure is formed of aluminum and has a highly reflective finish.

41. A cellular reflector in accordance with claim 33, wherein said honeycomb cell structure is in a curved shape being circular, oval or elliptical.

42. A cellular reflector in accordance with claim 33, wherein said honeycomb cell structure is formed in a shape selected from the group consisting of a triangle, a square, a rectangle, a circle, an oval, an ellipse, a pentagon, a hexagon, a heptagon, an octagon, a decagon and a polygon.

43. A cellular reflector in accordance with claim 33, wherein said means for connecting includes an electrical PC mounting board having a plurality of receptacles or sockets for said plurality of light sources being used.

44. A cellular reflector in accordance with claim 33, wherein said plurality of light sources are light-producing devices selected from the group consisting of incandescent bulbs, high intensity light bulbs, fluorescent bulbs, neon lamps, light emitting diodes (LEDs) and laser diodes.

45. A cellular reflector in accordance with claim 33, wherein said selected plurality of connected cells each have mounted therein at least two of said plurality of said light sources.

46. A cellular reflector in accordance with claim 33, wherein said selected plurality of connected cells each have mounted therein at least three (3) of said plurality of said internal light sources.

47. A cellular reflector in accordance with claim 33, wherein said reflective walls are coated with a reflective material.

48. A cellular reflector in accordance with claim 47, wherein said reflective material is selected from the group consisting of phosphorous, iridescent particles, reflective color compositions such as red, blue, and green, pearlescent particles, highly reflective metalized compositions and combinations thereof.

49. A cellular reflector in accordance with claim 33, wherein said cellular reflector is used as part of a traffic signal light.

50. A cellular reflector in accordance with claim 33, wherein said cellular reflector is used as part of an overhead street lamp.

51. A cellular reflector in accordance with claim 33, wherein said cellular reflector is used as part of a television screen.

52. A cellular reflector in accordance with claim 33, wherein said cellular reflector is used as part of a VDT display.

53. A cellular reflector in accordance with claim 33, wherein said cellular reflector is used as part of an automobile light.

54. A cellular reflector in accordance with claim 33, wherein said automobile light is in the form of a automobile marker light, a taillight, a brakelight, or a dome light.

55. A cellular reflector in accordance with claim 33, wherein said cellular reflector is used as part of an automobile headlamp.

56. A cellular reflector in accordance with claim 33, wherein said cellular reflector is used as part of a roadway lighting sign.

57. A cellular reflector in accordance with claim 33, wherein said cellular reflector is used as part of a roadway lighting fixture.

58. A cellular reflector in accordance with claim 33, wherein said cellular reflector is used as part of a lighting fixture for general illumination.

59. A cellular reflector in accordance with claim 33, wherein said cellular reflector is used as part of a lighting fixture for a photolithography apparatus.

60. A cellular reflector in accordance with claim 33, wherein said cellular reflector is used as part of a lighting fixture for photocopying machines.

* * * * *